US005329911A

United States Patent [19]

Jeong

[11] Patent Number: 5,329,911

[45] Date of Patent: Jul. 19, 1994

[54] FUEL ACTIVATION APPARATUS USING MAGNETIC BODY

[76] Inventor: Tae Y. Jeong, 508, Mabuk-ri Kusung-myon, Yongin-gun Kyunggi-do, Rep. of Korea

[21] Appl. No.: 121,234

[22] Filed: Sep. 14, 1993

[30] Foreign Application Priority Data

Aug. 24, 1993 [KR] Rep. of Korea ..... 93-16426

[51] Int. Cl.[5] ..... F02M 33/00

[52] U.S. Cl. ..... 123/538; 210/222

[58] Field of Search ..... 123/536, 537, 538; 210/222, 695

[56] References Cited

U.S. PATENT DOCUMENTS

| | | | |
|---|---|---|---|
| 2,652,925 | 9/1953 | Vermeiren | 210/222 |
| 3,830,621 | 8/1974 | Miller | 210/222 |
| 4,357,237 | 11/1982 | Sanderson | 210/222 |
| 4,372,852 | 2/1983 | Kovacs | 210/222 |
| 4,519,919 | 5/1985 | Whyte et al. | 210/695 |
| 4,538,582 | 9/1985 | Wakuta | 123/538 |
| 4,711,271 | 12/1987 | Weisenbarger et al. | 123/538 |
| 5,124,045 | 6/1992 | Janczak et al. | 123/538 |
| 5,154,153 | 10/1992 | MacGregor | 123/538 |
| 5,161,512 | 11/1992 | Adam et al. | 123/538 |

*Primary Examiner*—Tony M. Argenbright
*Assistant Examiner*—M. Macy
*Attorney, Agent, or Firm*—Dilworth & Barrese

[57] ABSTRACT

Disclosed is a fuel activation apparatus using a magnetic body, capable of ionizing fuels so as to obtain high combustion efficiency for a liquid or gas fuel. In the fuel activation apparatus, a fuel activation member of a magnetic material to make the fuels rotatably flow is inserted into the inner side of a fuel activation duct through which the fuels flow. A magnetic body is disposed on the external side of the fuel activation duct. A magnetic induction layer encloses the magnetic body and the fuel activation duct. Further, a magnetic shield layer is disposed in the external side of the magnetic induction layer. Thus, the ionization of the fuels which flow through the fuel activation duct is maximized, thereby heightening the combustion efficiency of the fuels.

12 Claims, 2 Drawing Sheets

FUEL ACTIVATION APPARATUS USING MAGNETIC BODY

BACKGROUND OF THE INVENTION

The present invention relates to a fuel activation apparatus using a magnetic body, and particularly to a fuel activation apparatus using a magnetic body, capable of maximizing ionization of fuel particles to obtain better fuel combustion efficiency, in which fuels rotate and flow in a fast speed under the influence of a magnetic force, to thereby split the fuel particles more minutely and repetitively.

Generally, a liquid or gas fuel used for an internal combustion engine is composed of a set of molecules. Each molecule includes a number of atoms, each of which is composed of a nucleus and electrons orbiting around their nucleus. The molecules have magnetic moments in themselves, and the rotating electrons cause magnetic phenomena.

Thus, positive (+) and negative (−) electric charges exist in the fuel's molecules. For this reason, the fuel particles of the negative and positive electric charges are not split into more minute particles. Accordingly, the fuels are not actively interlocked with oxygen during combustion, thereby causing incomplete combustion. To improve the above, the fuels have been required to be decomposed and ionized. Since all the liquid and gas fuels are very similar to conductive bodies, if a magnetic force is applied thereto from an external source, the ionization of the fuel particles is accomplished. Generally, the electrons orbiting around a circular orbit in a constant velocity generate magnetic moments. These moments generate magnetization forces by an amount proportional to movement velocity and orbit areas.

Thus, to maximize the ionization or magnetization, the movement of the electrons should become fast and the areas of the orbit should be widened. If a magnetic force is applied for a long time at an atmosphere of repeating operations of splitting and mixing the fuel particles for several times, Ion decomposition of the fuels is maximized according to a large amount of magnetization force.

Using the above phenomenon, a variety of the fuel ionization apparatus have been developed up to now. As one of them, an invention entitled "magnetic fuel ion modifier" is disclosed in U.S. Pat. No. 4,568,901. However, in that patent, three magnets are opposedly disclosed in which the same polarities face one another around a fuel duct. For this reason, the magnetic forces induced from the magnets are cancelled by repulsive forces due to the same polarities. Accordingly, the intensity of the magnetic forces which influences the fuel particles in the fuel duct is very small. Thus, an extremely small amount of the fuels is ionized, thereby expecting no better combustion efficiency.

Further, since the respective polarities of the several magnetic bodies should be correctly disposed, the fabrication is difficult and the cost of the product is high.

SUMMARY OF THE INVENTION

Therefore, to solve the above problems, it is an object of the present invention to provide a fuel activation apparatus using a magnetic body, capable of maximizing ionization of fuel particles in which since fuels rotate and flow via a fuel activation apparatus having a shape of a screw, the electron movement velocity of the fuel particles becomes fast and the flowing areas of the fuel becomes large, thereby enabling the fuel particles to pass through a magnetic field for a comparatively long time.

Another object of the present invention is to provide a fuel activation apparatus using a magnetic body in which only a single magnetic body is used, thereby enabling easy fabrication and small cost.

To accomplish the above object of the present invention, there is provided a fuel activation apparatus using a magnetic body, the fuel activation apparatus comprising: a fuel activation duct having a shape of a hollow pipe, which is connected between a fuel supply end and a fuel consumer end and which is provided as a fuel supply path; a fuel activation member which is disposed inside the fuel activation duct, and which is made of a magnetic material to make the fuels rotatably flow; a magnetic body having a shape of a bar, which is disposed adjacently to the external surface of the fuel activation duct; and a magnetic induction layer made of a magnetic material, which is disposed so as to enclose the fuel activation duct and the magnetic body, to thereby induce a magnetic force from the magnetic body.

DETAILED DESCRIPTION OF THE PREFERRED EMBODIMENT

A preferred embodiment of the present invention will be described below in more detail with reference to the accompanying drawings.

Figure 1:
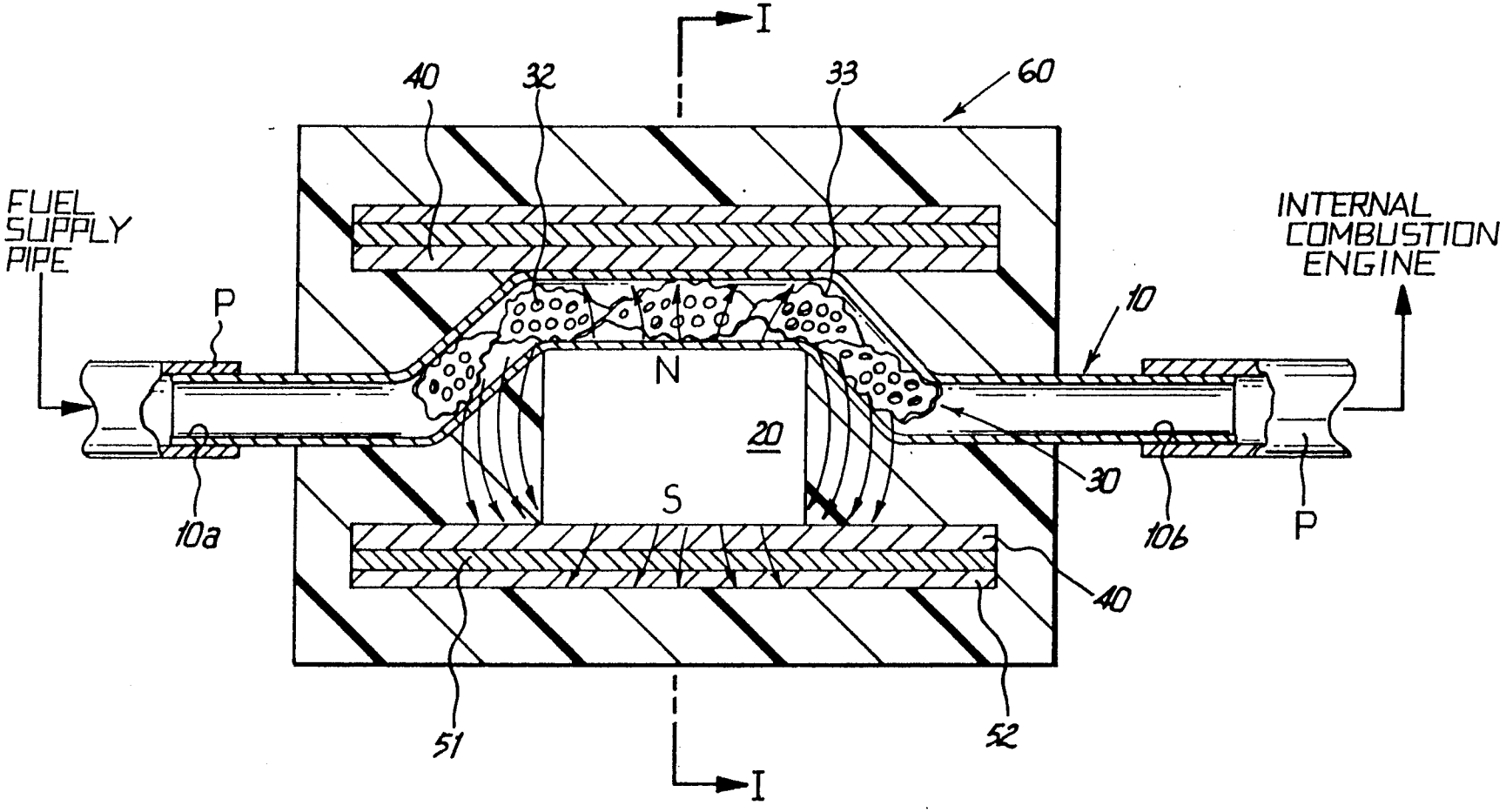
FIG. 1 is a lengthwisely cross-sectional view of a fuel activation apparatus using a magnetic body according to the present invention.
Figure 2:
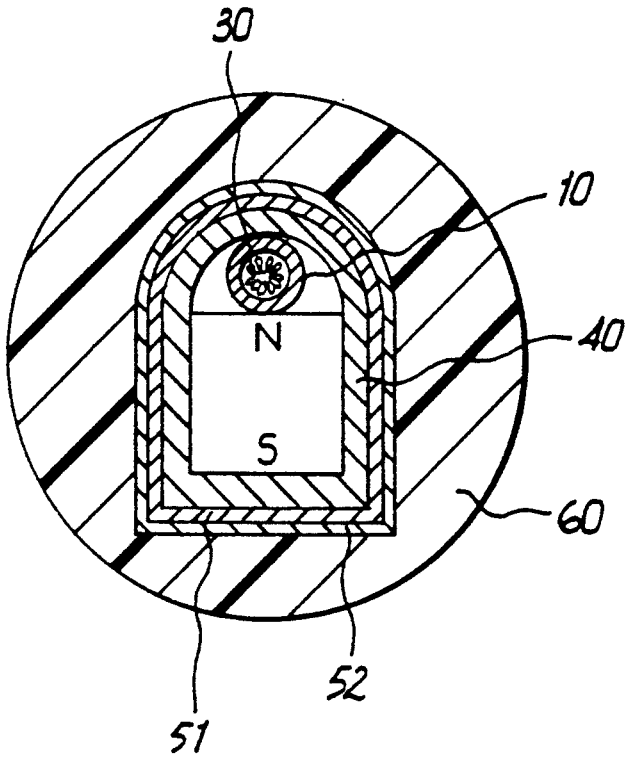
FIG. 2 is a laterally cross-sectional view of a fuel activation apparatus along a line I—I of FIG. 1.

As can be seen from FIGS. 1 and 2, the fuel activation apparatus using a magnetic body according to the present invention comprises a hollow fuel activation duct 10 having a predetermined length. One end 10*a* of fuel activation duct 10 is connected to a fuel supply pipe P of a fuel supply source (not shown), while the other end 10*b* thereof is connected to fuel supply pipe P of a fuel consumer end (not shown). It is preferred to design fuel activation duct 10 so that the substantially centric portions of fuel activation duct 10 are bent as shown in FIG. 1. The reason is because both ends 10*a* and 10*b* of fuel activation duct 10 should be located in the center of casing 60. On a predetermined portion of the external surface in fuel activation duct 10 is installed a single magnetic body 20 for magnetizing activation duct 10. Here, it is preferred that the N pole of magnetic body 20 is disposed so as to be contacted to the external surface of fuel activation duct 10. The reason is because the magnetic forces of magnetic body 20 are directed from the N pole to the S pole as shown in FIG. 1. Thus, fuel activation duct 10 is magnetized and the fuel flowing therethrough is more actively decomposed and ionized.

Figure 3:
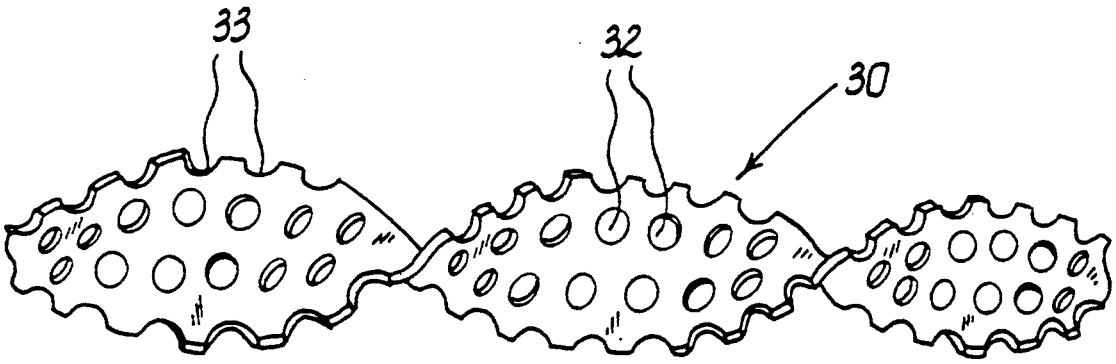
FIG. 3 is a perspective view with respect to a fuel activation member of the fuel activation apparatus according to the present invention.

In fuel activation duct 10 is installed fuel activation member 30. FIG. 3 is a perspective view of such a fuel activation member 30. As can be seen from FIG. 3, fuel activation member 30 is formed of a perforated metal plate having a predetermined length and width, and a plurality of perforated holes 32 thereon. The metal plate is twistly formed in a shape of a screw. Also, at the periphery of the metal plate is formed a plurality of recessed grooves 33 each of which has a shape of a semi-circle. The periphery of the metal plate having recessed grooves 33 is installed so as to be contacted with the inner wall surface of fuel activation duct 10.

Here, fuel activation member 30 is inserted into fuel activation duct 10 before bending fuel activation duct 10. Thereafter, it is preferred that fuel activation duct 10 is bent as shown in FIG. 1.

Referring again to FIGS. 1 and 2, around fuel activation duct 10 and magnetic body 20 is disposed a magnetic induction layer 40 so as to completely enclose fuel activation duct 10 and magnetic body 20. Preferably, magnetic induction layer 40 is formed of a magnetic material, for example, a metal plate. Therefore, the magnetic force of magnetic body 20 is induced around fuel activation duct 10 by magnetic induction layer 40. Accordingly, the magnetization of fuel activation duct 10 and fuel activation member 30 is expedited.

At the external side of magnetic induction layer 40 is formed a magnetic shield layer made of a non-magnetic material which encloses magnetic induction layer 40. In this embodiment, the magnetic shield layer is composed of a double structure of a first magnetic shield layer 51 and a second magnetic shield layer 52 as can be seen from FIGS. 1 and 2. Such magnetic shield layers regulate the intensity of the magnetic force of magnetic body 20 which influences fuel activation duct 10. The more magnetic shield layers 51 and 52 are formed, the more the magnetic force lines coming from magnetic body 20 are shielded by shield layers 51 and 52. Accordingly, the magnetic field is formed only inside magnetic induction layer 40, thereby enabling the high magnetic force (having a large gauss) to be functioned at fuel activation duct 10.

The number of the magnetic shield layers can be controlled according to the class or component ratio of the fuel. For example, in case that the fuel contains a large amount of hydrocarbon, the more number of the shield layers is formed, the better it is. Also, in this embodiment, although the magnetic shield layer of the double structure is formed, a use of a single thick magnetic shield layer instead of the multi-layered magnetic shield layer can obtain the same effect as that of the multi-layered magnetic shield layer.

The fuel activation apparatus according to the present invention comprises an external casing 60 coated with a material such as a resin thereon to enclose the whole fuel activation duct 10 excluding both ends 10*a* and 10*b* of fuel activation duct 10. Preferably, external casing 60 has a cylindrical shape, and both ends 10*a* and 10*b* of fuel activation duct 10, which are externally protruded are located in the center of cylindrical casing 60.

The operation of the fuel activation apparatus using the magnetic body according to the present invention will be described in more detail.

First, in the fuel activation apparatus of the present invention, both ends 10*a* and 10*b* of fuel activation duct 10 are connected between the fuel supply end and the fuel consumer end, in such a manner that waterproof properties are maintained. The fuels flow from the fuel supply end to the fuel consumer end via fuel activation duct 10. Here, fuel activation duct 10 and fuel activation member 30 located in fuel activation duct 10 maintain the magnetized states by being magnetized by magnetic body 20 and magnetic induction layer 40 enclosing fuel activation duct 10 and magnetic body 20. Thus, the fuels passing through the magnetized portions are magnetized directly by the magnetic force lines coming from magnetic body 20. Also, the fuels are magnetized by the contacts to magnetized fuel activation duct 10 and fuel activation member 30. Accordingly, the fuels are more actively ionized. Particularly, since fuel activation member 30 is formed in a shape of a screw, the fuels tend to flow rotatably along screwed wings. The moving velocity of the electrons become faster by the rotational flow of the fuels. Also, the areas of the fuel flowing path become large, and the fuels can pass through the magnetic field for a comparatively long time. Accordingly, the magnetization of the fuels can be maximized. Thus, a large number of the fuel particles can be ionized. Also, the fuel activation apparatus according to the present invention forms the magnetic shield layer. Accordingly, the externally transmitted magnetic loss is shielded, thereby further maximizing the ionization of the fuel particles.

As described above, according to the present invention, the fuels passing through the fuel activation duct receive the magnetic force coming from the magnetic body. Simultaneously, the fuels flow in direct contact with the magnetized fuel activation duct and the magnetized fuel activation member. As a result, since the fuels pass through the magnetic field for a comparatively longer time, the fuel particles are ionized and decomposed, and minutely split to make an activation state. Accordingly, the fuel efficiency can be maximized, thereby preventing the material which is not completely combusted from being emitted due to the improvement of the combustion efficiency to solve the air pollution.

What is claimed is:

1. A fuel activation apparatus using a magnetic body, said fuel activation apparatus comprising:

a fuel activation duct having a shape of a hollow pipe, which is connected between a fuel supply end and a fuel consumer end and which is provided as a fuel supply path;

a fuel activation member which is disposed inside said fuel activation duct, and which is made of a magnetic material to make the fuels rotatably flow;

a magnetic body having a shape of a bar, which is disposed adjacently to the external surface of said fuel activation duct; and a magnetic induction layer made of a magnetic material, which is disposed so as to enclose said fuel activation duct and said magnetic body, to thereby induce a magnetic force from said magnetic body.

2. A fuel activation apparatus using a magnetic body according to claim 1, further comprising a magnetic shield layer made of a non-magnetic material on the external side of said magnetic induction layer.

3. A fuel activation apparatus using a magnetic body according to claim 2, further comprising an external casing which is molded as a resin on the external side of said shield layer.

4. A fuel activation apparatus using a magnetic body according to claim 2, wherein said magnetic shield layer has a double structure.

5. A fuel activation apparatus using a magnetic body according to claim 1, wherein said fuel activation member is a metal plate having a predetermined length and a predetermined width, and is wound in a shape of a screw so that the fuels rotatably flow.

6. A fuel activation apparatus using a magnetic body according to claim 5, wherein said metal plate forms a plurality of fuel path holes.

7. A fuel activation apparatus using a magnetic body according to claim 6, wherein said metal plate forms a plurality of recessed grooves on the periphery of the metal plate.

8. A fuel activation apparatus using a magnetic body according to claim 7, wherein the periphery portion of said metal plate is contact with the inner wall of said fuel activation duct.

9. A fuel activation apparatus using a magnetic body according to claim 1, wherein the fuel activation duct is bent in a predetermined angle at both end portions of said magnetic body in a form such that the bent duct portion partially encloses said magnetic body.

10. A method for improving the ionization of fuel particles, comprising the steps of:

flowing fuel having fuel particles through a duct;

directing the flow of the fuel particles in substantial conformance to the shape of a magnetic fuel activation member disposed within the duct;

creating a magnetic field around said fuel particles for ionizing said fuel particles and employing a magnetic body adjacent to the external surface of the duct and a magnetic induction layer which encloses the duct and the magnetic body.

11. A method according to claim 10 wherein said step of directing the flow of fuel particles includes shaping said fuel activation member for increasing the velocity of flow of said fuel particles.

12. A method according to claim 10 wherein said step of directing the flow of fuel particles includes shaping said fuel activation member for increasing the area of the fuel flow path in the induced magnetic field.

* * * * *